US005391475A

United States Patent [19]

Nishigaki et al.

[11] Patent Number: 5,391,475

[45] Date of Patent: Feb. 21, 1995

[54] SILVER HALIDE COLOR PHOTOGRAPHIC PHOTOSENSITIVE MATERIALS

[75] Inventors: Junji Nishigaki; Fumitaka Ueda; Akihiko Ikegawa, all of Kanagawa, Japan

[73] Assignee: Fuji Photo Film Co., Ltd., Kanagawa, Japan

[21] Appl. No.: 56,782

[22] Filed: May 4, 1993

[30] Foreign Application Priority Data

May 12, 1992 [JP] Japan ..... 4-144981

[51] Int. Cl.[6] ..... G03C 1/09

[52] U.S. Cl. ..... 430/600; 430/581; 430/583; 430/588; 430/601; 430/603

[58] Field of Search ..... 430/603, 600, 601, 588, 430/581, 583

[56] References Cited

U.S. PATENT DOCUMENTS 2,295,276 9/1942 Wilmanns et al. ..... 430/588
5,236,821 8/1993 Yagihara et al. ..... 430/603
5,244,782 9/1993 Mifune et al. ..... 430/588

*Primary Examiner*—Thorl Chea

*Attorney, Agent, or Firm*—Sughrue, Mion, Zinn, Macpeak & Seas

[57] ABSTRACT

Disclosed is a silver halide color photographic photosensitive material in which the spectral sensitivity in the green short wavelength region is increased and which has excellent storage stability. The photosensitive material is sensitized by a selenium sensitizer represented by formula (I). Also, a green light sensitive photosensitive silver halide emulsion layer has been spectrally sensitized with a sensitizing dye represented by formula (II).

(I)

(II)

9 Claims, No Drawings

SILVER HALIDE COLOR PHOTOGRAPHIC PHOTOSENSITIVE MATERIALS

FIELD OF THE INVENTION

This invention concerns silver halide photographic photosensitive materials and, more precisely, it concerns photographic photosensitive materials which contain silver halide photographic emulsions which have been spectrally sensitized in the green short wavelength region and which have excellent storage stability.

BACKGROUND OF THE INVENTION

There is a need for a technique by which the spectral sensitivity of the green short wavelength region in a silver halide color photographic photosensitive material can be raised and by which the color reproduction of the photosensitive material can be improved.

Known techniques for increasing the spectral sensitivity of the green wavelength region include photographic emulsions in which conventional oxacarbocyanines and benzimidazolocarbocyanines are used conjointly (for example JP-A-59-116646, JP-A-59-116647, JP-A-59-140443 and JP-A-59-149346), in which oxacarbocyanines and oxathiacarbocyanines are used conjointly (for example, JP-B-46-11627 and JP-A-60-42750), and in which two or more oxacarbocyanines are used conjointly (for example JP-A-52-23931). But in all these cases, the spectral sensitivity of the green short wavelength region of 520 to 545 nm is low and difficulties arise with color reproduction. (The term "JP-A" as used herein signifies an "unexamined published Japanese patent application", and the term "JP-B" as used herein signifies an "examined Japanese patent publication".)

The conjoint use of sensitizing dyes which have a spectral sensitivity peak in the range 520 to 545 nm has also been considered. However, in the past benzimidazolooxazolocarbocyanine (for example JP-B-44-14030) and dimethinemerocyanine (for example U.S. Pat. Nos. 2,493,748, 2,519,001 and 3,480,439) were known as sensitizing dyes which had a spectral sensitivity peak value of not less than 520 nm and less than 545 nm. But with emulsions to which benzimidazolooxazolocarbocyanine or dimethinemerocyanine have been added, the fog level increases at elevated temperatures or under conditions of high temperature and high humidity after the emulsion has been coated. Or there is a worsening of the ageing stability and a loss of photographic speed after the emulsion has been coated. It is therefore thought that the conjoint use of these compounds is inappropriate.

Furthermore, the oxacarbocyanines, for which the problems described above are minor, have a spectral sensitivity peak value of 520 to 545 nm and have been disclosed for example in U.S. Pat. Nos. 2,521,705, 2,521,959 and 2,647,054 and in JP-A-63-167348. But the spectral sensitivity of these dyes is inadequate. Furthermore, a mono-methinecyanine which includes a 2-quinoline skeleton has a spectral sensitivity peak value of 520 to 545 nm. But when they are used individually, photographic speed is low and so they are used conjointly with benzoimidazolocarbocyanine and oxacarbocyanine (for example JP-B-56-24939, JP-B-56-38936, JP-B-56-38940 and British Patent 1,219,016). However, when they are used conjointly in this way, the spectral sensitivity region is inevitably shifted to a longer wavelength and so good color reproduction cannot be obtained. Hence, a technique for increasing spectral sensitivity in the green short wavelength region is required for obtaining faithful color reproduction with a color photosensitive material.

SUMMARY OF THE INVENTION

An object of the present invention is to provide color photographic photosensitive materials with which the spectral sensitivity of the green short wavelength region is increased and which have excellent ageing stability.

This and other objects of the invention have been realized by means of a silver halide color photographic photosensitive material which has been sensitized with a selenium sensitizer represented by formula (I) below. The green sensitive photosensitive silver halide emulsion layer has been spectrally sensitized with a least one sensitizing dye represented by formula (II) below.

Moreover, the use of a sensitizing dye represented by formula (III) below in the abovementioned emulsion is more desirable.

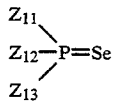

(I)

In formula (I), $Z_{11}$, $Z_{12}$ and $Z_{13}$ may be the same or different and each represents an alkyl group, an aryl group, a heterocyclic group, a halogen atom, a hydrogen atom, $—OR_{11}$, $—NR_{12}(R_{13})$, $—SR_{14}$ or $—SeR_{15}$.

$R_{11}$, $R_{14}$ and $R_{15}$ may be the same or different and represent alkyl groups, aryl groups, heterocyclic groups, hydrogen atoms or cations, and $R_{12}$ and $R_{13}$ may be the same or different and represent alkyl groups, aryl groups, heterocyclic groups or hydrogen atoms.

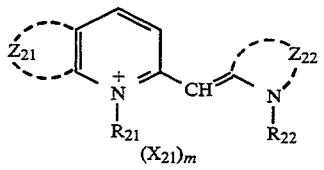

(II)

In formula (II), $R_{21}$ and $R_{22}$ each represents an alkyl group, $Z_{21}$ represents a group of atoms which is required to form a benzene ring, $Z_{22}$ represents a group of atoms which is required to form a benzothiazole or benzoselenazole nucleus, $X_{21}$ represents a counter-ion, m represents 0 or 1, and m is 0 in those cases in which an intramolecular salt is formed.

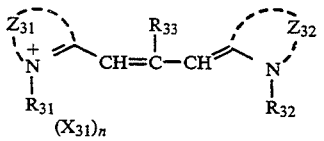

(III)

In formula (III), $R_{31}$, $R_{32}$ and $R_{33}$ each represents an alkyl group, and $Z_{31}$ and $Z_{32}$ may be the same or different and each represents a group of atoms which is required to form a benzoxazole nucleus, a naphthoxazole nucleus, a benzothiazole nucleus, a naphthothiazole nucleus, a benzimidazole nucleus or a naphthimidazole nucleus.

Moreover, $X_{31}$ represents a counter ion, n represents 0 or 1, and n is 0 in those cases in which an intramolecular salt is formed.

DETAILED DESCRIPTION OF THE INVENTION

Formula (I) is described in more detail below.

The alkyl groups represented by $Z_{11}$, $Z_{12}$, $Z_{13}$, $R_{11}$, $R_{12}$, $R_{13}$, $R_{14}$ and $R_{15}$ in formula (I) include linear chain and cyclic alkyl groups, alkenyl groups, alkynyl groups, aralkyl groups (for example methyl, ethyl, n-propyl, isopropyl, t-butyl, n-butyl, n-octyl, n-decyl, n-hexadecyl, cyclopentyl, cyclohexyl, allyl, 2-butenyl, 3-pentenyl, propargyl, 3-pentenyl, benzyl, phenethyl). The aryl groups represented by $Z_{11}$, $Z_{12}$, $Z_{13}$, $R_{11}$, $R_{12}$, $R_{13}$, $R_{14}$ and $R_{15}$ in formula (I) include single ring and condensed ring aryl groups (for example phenyl, pentafluorophenyl, 4-chlorophenyl, 3-sulfophenyl, 1-naphthyl, 4-methylphenyl). The heterocyclic groups represented by $Z_{11}$, $Z_{12}$, $Z_{13}$, $R_{11}$, $R_{12}$, $R_{13}$, $R_{14}$ and $R_{15}$ in formula (I) are three- to ten-membered saturated or unsaturated heterocyclic groups which contain at least one nitrogen, oxygen or sulfur atom (for example pyridyl, thienyl, furyl, thiazolyl, imidazolyl, benzimidazolyl). The cations represented by $R_{11}$, $R_{14}$ and $R_{15}$ in formula (I) are alkali metal ions or ammonium, and the halogen atoms represented by $Z_{11}$, $Z_{12}$ and $Z_{13}$ are, for example, a fluorine atom, a chlorine atom, a bromine atom or an iodine atom.

$Z_{11}$, $Z_{12}$ or $Z_{13}$ in formula (I) is preferably a linear chain or cyclic alkyl group, or a single or condensed ring aryl group.

$R_{11}$, $R_{12}$, $R_{13}$, $R_{14}$ or $R_{15}$ in formula (I) is preferably a linear chain alkyl group, or a single ring aryl group.

Formula (I) preferably represents a trialklyphosphine selenide, a triarylphosphine selenide, a trialkyl selenophosphate or a triaryl selenophosphate.

Formula (II) is described in more detail below.

$Z_{21}$ in formula (II) represents a group of atoms which is required to form a benzene ring, and at least one atom among this group of atoms may be substituted with an alkyl group, an alkoxy group or an aryloxy group. It is preferred that the condensing benzene ring formed by $Z_{21}$ is substituted with an alkyl group in such a manner that the 6-position of the resulting quinone ring is substituted with the alkyl group. Here, the alkyl group by which $Z_{21}$ is substituted is, for example, a methyl, ethyl, n-propyl, isopropyl, t-butyl, n-butyl, n-octyl, n-decyl, n-hexadecyl, cyclopentyl or cyclohexyl group, and it is preferably a methyl or ethyl group.

The alkoxy group is, for example, a methoxy, ethoxy, propoxy or methylenedioxy group, and it is preferably a methoxy group.

The aryloxy group is, for example, a phenoxy, 4-methylphenoxy or 4-chlorophenoxy group, and it is preferably a phenoxy group.

$Z_{22}$ represents a group of atoms which is required to form a benzothiazole nucleus or a benzoselenazole nucleus, and these nuclei may have substituent groups. $Z_{22}$ preferably represents a benzothiazole nucleus which is substituted in the 5-position with a halogen atom, an alkyl group, an alkoxy group, an alkylthio group or an aryl group. Here, the halogen atom with which the benzothiazole nucleus is substituted is, for example, a fluorine atom, a chlorine atom, a bromine atom or an iodine atom, and it is preferably a bromine or chlorine atom.

The alkyl group may have substituent groups and it is, for example, a methyl, ethyl, n-propyl, isopropyl, t-butyl, n-butyl, n-octyl, n-decyl, n-hexadecyl, cyclopentyl, cyclohexyl, trifluoromethyl or hydroxyethyl group, and it is preferably a trifluoromethyl group.

The alkoxy group is, for example, a methoxy, ethoxy, propoxy or methylenedioxy group, and it is preferably a methoxy group.

The alkylthio group is, for example, a methylthio, ethylthio or propylthio group, and it is preferably a methylthio group.

The aryl group is, for example, a phenyl, pentafluorophenyl, 4-chlorophenyl, 3-sulfophenyl or 4-methylphenyl group, and it is preferably a phenyl group.

In formula (II), the alkyl groups represented by $R_{21}$ and $R_{22}$ may have substituent groups, and preferably at least one of them is substituted with a sulfoalkyl group or a carboxyalkyl group. Cases in which both are substituted with sulfoalkyl groups are preferred.

In practical terms, alkyl groups which have 1 to 8 carbon atoms (for example, methyl, ethyl, n-propyl, isopropyl, n-butyl, n-pentyl, n-hexyl, n-octyl), aralkyl groups which have 7 to 10 carbon atoms (for example benzyl, phenethyl, 3-phenylpropyl) and alkyl groups which have 1 to 8 carbon atoms and aralkyl groups which have 7 to 10 carbon atoms which are substituted with hydroxyl group, carboxyl group, sulfo group, cyano group, halogen atoms (for example fluorine, chlorine, bromine or iodine), alkoxycarbonyl groups which have 2 to 8 carbon atoms (for example methoxycarbonyl, ethoxycarbonyl, benzyloxycarbonyl), alkoxy groups which have 1 to 8 carbon atoms (for example methoxy, ethoxy, propoxy, butyloxy, benzyloxy, phenethyloxy), aryloxy groups which have 6 to 8 carbon atoms (for example phenoxy, p-tolyloxy), acyloxy groups which have 1 to 8 carbon atoms (for example acetyloxy, propionyloxy, benzoyloxy), acyl groups which have 1 to 8 carbon atoms (for example acetyl, propionyl, benzoyl, 4-fluorobenzoyl), carbamoyl groups which have 1 to 6 carbon atoms (for example carbamoyl, N,N-dimethylcarbamoyl, morpholinocarbonyl, piperidinocarbonyl), sulfamoyl groups which have 1 to 6 carbon atoms (for example sulfamoyl, N,N-dimethylsulfamoyl, morpholinosulfonyl, piperidinosulfonyl) or aryl groups which have 6 to 10 carbon atoms (for example phenyl, p-fluorophenyl, p-carboxyphenyl, p-hydroxyphenyl, p-sulfophenyl) are preferred as substituent groups to $R_{21}$ and $R_{22}$.

The most desirable alkyl groups represented by $R_{21}$ and $R_{22}$ are the sulfoethyl group, the sulfopropyl group, the sulfobutyl group, the carboxymethyl group and the carboxyethyl group.

In general formula (II), $X_{21}$ represents a charge balancing counter-ion. The ion which cancels the charge within the molecule is selected from anions and cations. The anions are inorganic or organic acid anions (for example p-toluenesulfonate, p-nitrobenzenesulfonate, methanesulfonate, methyl sulfate, ethyl sulfate, perchlorate) or a halogen ion (for example chloride, bromide, iodide). The cations are inorganic and organic cations, and examples include hydrogen ion, alkali metal ions (for example lithium, sodium, potassium and cesium ions), alkaline earth metal ions (for example magnesium, calcium and strontium ions), ammonium ion and organic ammonium ions (for example triethanolammonium and pyridinium ions).

Moreover, m represents 0 or 1, and m is 0 in those cases where an intramolecular salt is formed.

Formula (III) is described in more detail below.

The nuclei which are formed by $Z_{31}$ or $Z_{32}$ may have substituent groups, and they represent benzothiazole nuclei (for example benzothiazole, 4-chlorobenzothiazole, 5-chlorobenzothiazole, 6-chlorobenzothiazole, 5-nitrobenzothiazole, 4-methylbenzo-thiazole, 5-methylbenzothiazole, 6-methylbenzothiazole, 5-bromobenzothiazole, 6-bromobenzothiazole, 5-iodobenzothiazole, 5-phenylbenzothiazole, 5-methoxybenzothiazole, 6-methoxybenzothiazole, 5-ethoxybenzothiazole, 5-ethoxycarbonylbenzothiazole, 5-carboxybenzothiazole, 5-phenethylbenzothiazole, 5-fluorobenzothiazole, 5-chloro-6-methylbenzothiazole, 5,6-dimethylbenzothiazole, 5,6-dimethoxybenzothiazole, 5-hydroxy-6-methylbenzothiazole, tetrahydrobenzothiazole, 4-phenylbenzothiazole), naphthothiazole nuclei (for example naphtho[2,1-d]-thiazole, naphtho[1,2-d]thiazole, naphtho[2,3-d]-thiazole, 5-methoxynaphtho[1,2-d]thiazole, 7-ethoxynaphtho[2,1-d]thiazole, 8-methoxynaphtho[2,1-d]thiazole, 5-methoxynaphtho[2,3-d]thiazole), benzoxazole nuclei (for example benzoxazole, 5-chlorobenzoxazole, 5-methylbenzoxazole, 5-bromobenzoxazole, 5-fluorobenzoxazole, 5-phenylbenzoxazole, 5=methoxybenzoxazole, 5-nitrobenzoxazole, 5-trifluoromethylbenzoxazole, 5-hydroxybenzoxazole, 5-carboxybenzoxazole, 6-methylbenzoxazole, 6-chlorobenzoxazole, 6-nitrobenzoxazole, 6-methoxybenzoxazole, 6-hydroxybenzoxazole, 5,6-dimethylbenzoxazole, 4,6-dimethylbenzoxazole, 5-ethoxybenzoxazole), naphthoxazole nuclei (for example naphtho[2,1-d]oxazole, naphtho[1,2-d]oxazole, naphtho[2,3-d]oxazole, 5-nitronaphtho[2,1-d]oxazole), benzimidazole nuclei (for example, 1-alkylbenzimidazole, 1-alkyl-5-chlorobenzimidazole, 1-alkyl-5,6-dichlorobenzimidazole, 1-alkyl-5-methoxybenzimidazole, 1-alkyl-5-cyanobenzimidazole, 1-alkyl-5-fluorobenzimidazole, 1-alkyl-5-trifluoromethylbenzimidazole, 1-alkyl-6-chloro-5-cyanobenzimidazole, 1-alkyl-6-chloro-5-trifluoromethylbenzimidazole, 1-allyl-5,6-dichlorobenzimidazole, 1-allyl-5-chloro-benzimidazole, 1-arylbenzimidazole, 1-aryl-5-chlorobenzimidazole, 1-aryl-5,6-dichlorobenzimidazole, 1-aryl-5-methoxybenzimidazole, 1-aryl-5-cyanobenzimidazole), or naphthimidazole nuclei (for example 1-alkylnaphtho[2,1-d]imidazole), 1-arylnaphtho[1,2-d]imidazole).

A benzothiazole nucleus, a benzoxazole nucleus or a naphthoxazole nucleus is preferred as the nucleus which is formed by $Z_{31}$ or $Z_{32}$.

$R_{31}$ and $R_{32}$ are of the same meaning as $R_{21}$ and $R_{22}$ in formula (II), and they preferably represent sulfoethyl groups, sulfopropyl groups, sulfobutyl groups, carboxymethyl groups or carboxyethyl groups.

In formula (III), $X_{31}$ represents a charge balancing counter-ion. The ion which cancels the charge within the molecule is selected from anions and cations. The anions are inorganic or organic acid anions (for example p-toluenesulfonate, p-nitrobenzenesulfonate, methanesulfonate, methyl sulfate, ethyl sulfate, perchlorate) or a halogen ion (for example chloride, bromide, iodide). The cations include inorganic and organic cations, and examples include hydrogen ion, alkali metal ions (for example lithium, sodium, potassium and cesium ions), alkaline earth metal ions (for example magnesium, calcium and strontium ions), ammonium ion, and organic ammonium ions (for example triethanolammonium and pyridinium ions).

Moreover, n represents 0 or 1, and n is 0 in those cases where an intramolecular salt is formed.

Examples of compounds which can be represented by formulae (I), (II) or (III) described above are shown below, but the sensitizing dyes which can be used in the invention are not limited to these examples:

I-1

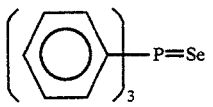

I-2

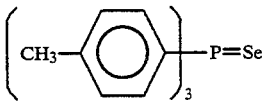

I-3

$(nC_4H_9)_3P{=}Se$

I-4

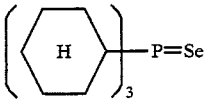

I-5

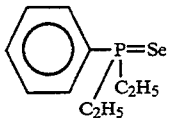

I-6

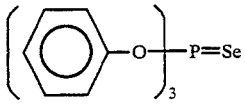

I-7

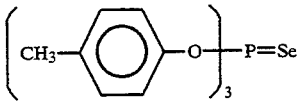

I-8

$(nC_4H_9O)_3P{=}Se$

I-9

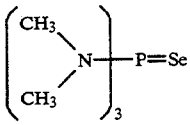

I-10

$(C_2H_5O)_3P{=}Se$

-continued
I-11
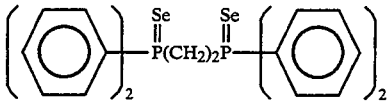
I-12
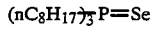
I-13
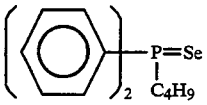
I-14
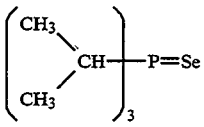
I-15
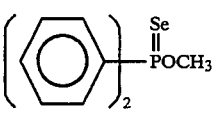
I-16
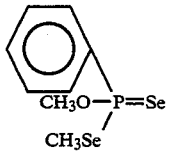
I-17
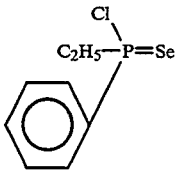
I-18
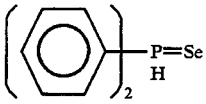
I-19
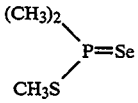
I-20
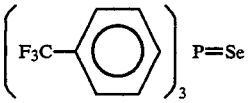
I-21
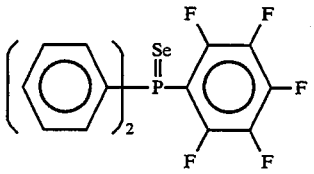
II-1
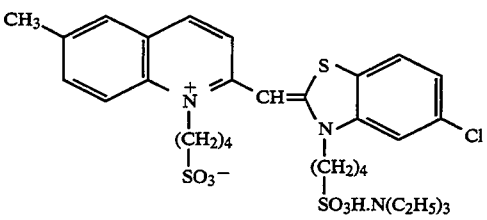
II-2
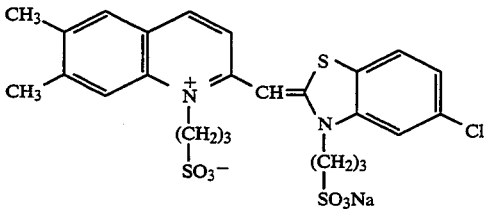
II-3
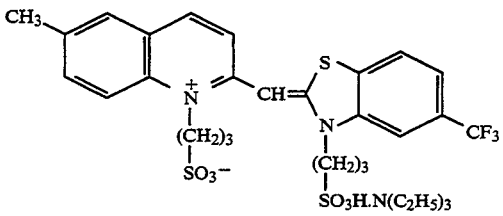
II-4
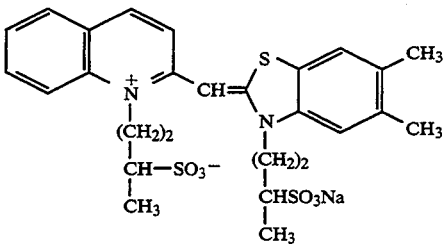
II-5
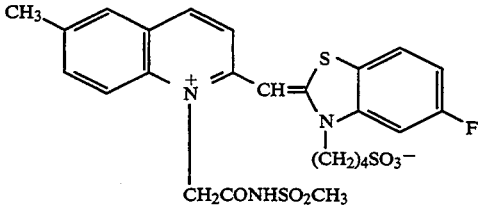

-continued
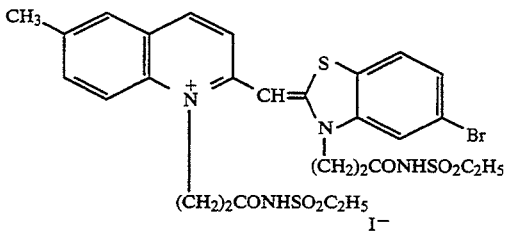
II-6
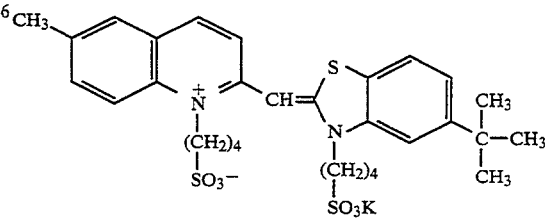
II-7
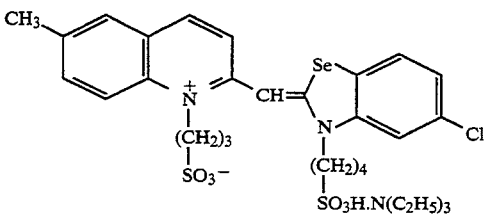
II-8
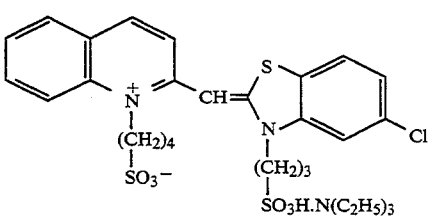
II-9
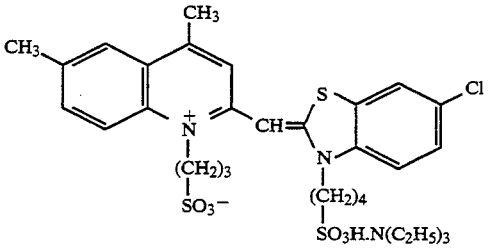
II-10
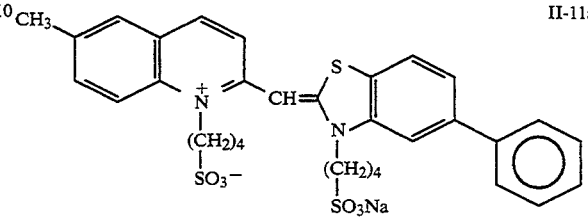
II-11a
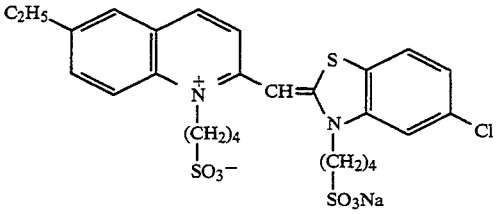
II-11b
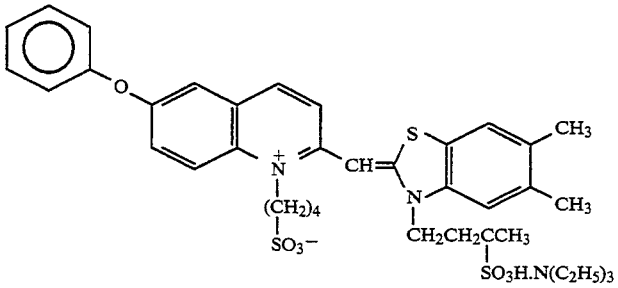
II-12
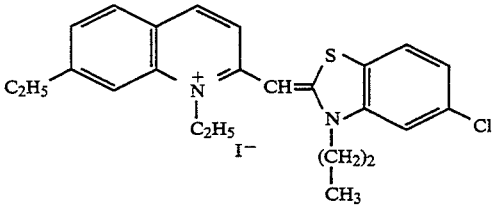
II-13
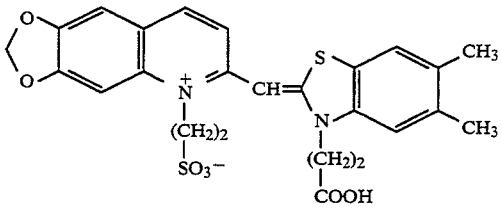
II-14
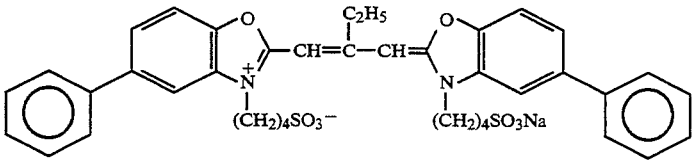
III-1

-continued
III-2
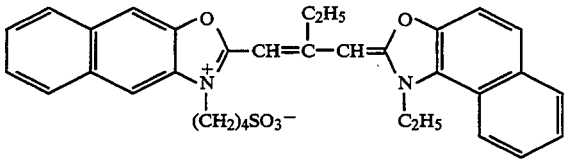
III-3
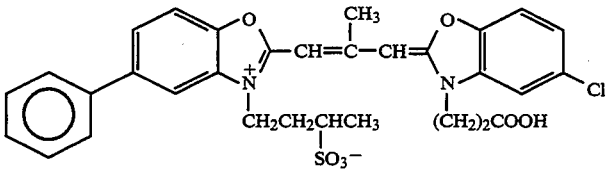
III-4
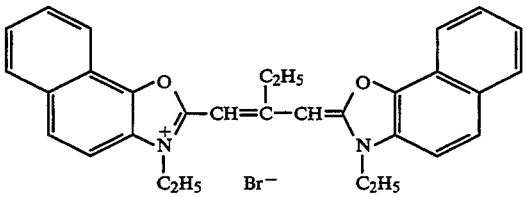
III-5
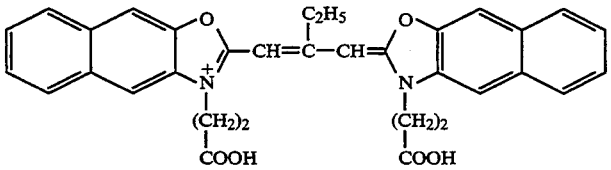
III-6
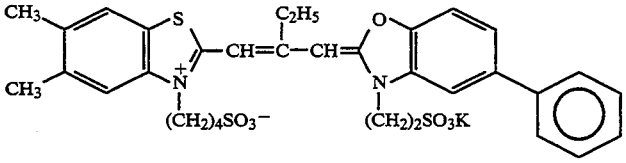
III-7
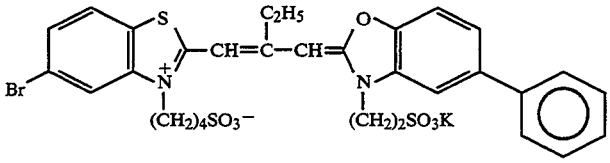
III-8
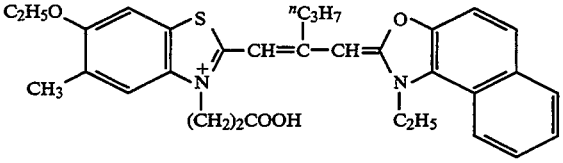
III-9
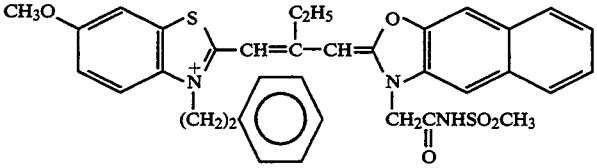

-continued
III-10
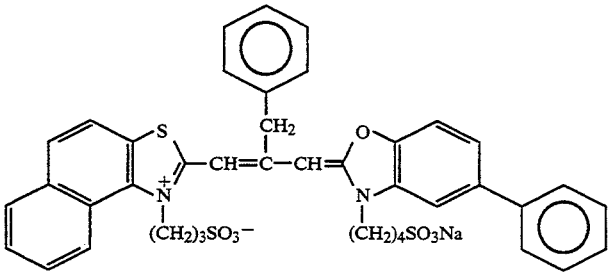
III-11
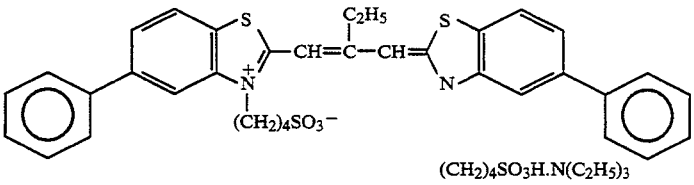
III-12
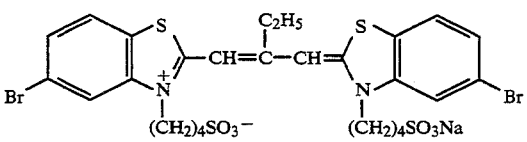
III-13
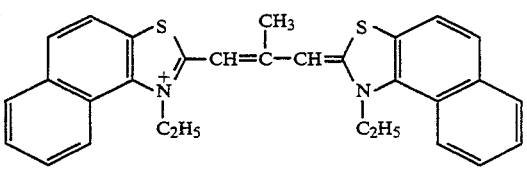
III-14
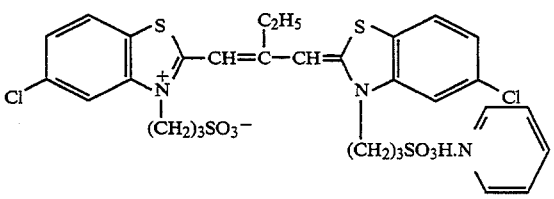
III-15
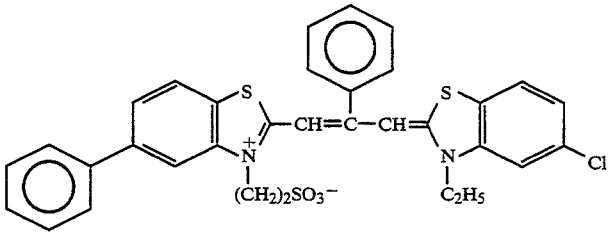
III-16
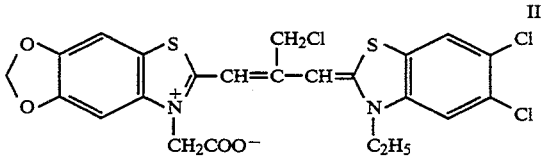
III-17
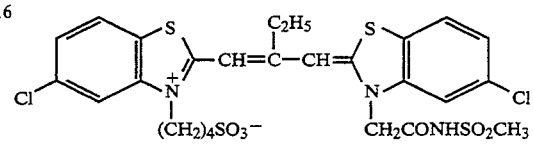
III-18
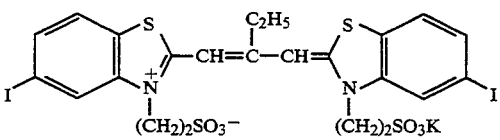
III-19
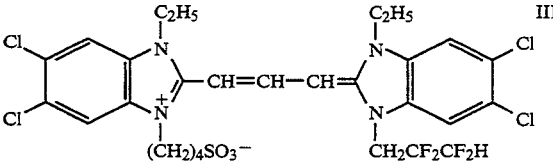

-continued

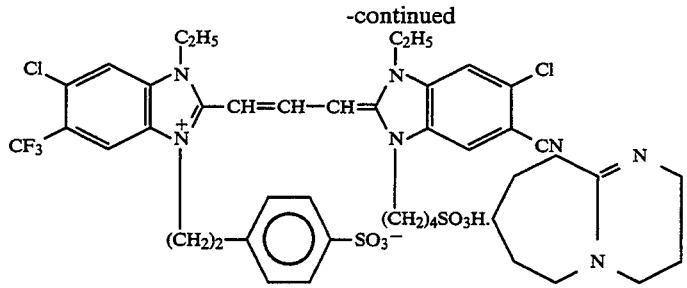

III-20

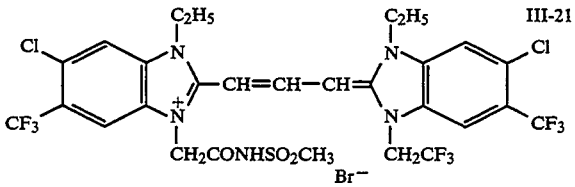

III-21

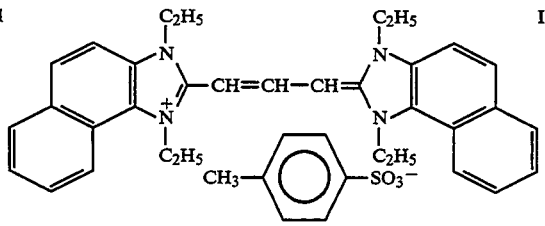

III-22

Disclosures in connection with the selenium sensitization method have been made, for example, in U.S. Pat. Nos. 1,574,944, 1,602,592, 1,623,499, 3,297,446, 3,320,069, 3,408,196, 3,442,653, 3,420,670 and 3,591,685, French Patents 2,693,038 and 2,093,209, JP-B-52-34491, JP-B-52-34492, JP-B-53-295 and JP-B-57-22090, and by H. E. Spenser et al. in *Journal of Photographic Science*, Vol. 31, pages 158 to 169 (1983). In general, selenium sensitization has a greater sensitizing effect than sulfur sensitization which is generally used in the industry, but it gives rise to increased fogging and there is a tendency towards a softening of tone.

The selenium sensitizers represented by formula (I) of this present invention are unstable type selenium compounds which can form a precipitate of silver selenide upon reacting with silver nitrate in aqueous solution. Unstable type selenium compounds and methods for making the compounds have been disclosed, for example, in U.S. Pat. Nos. 1,574,944, 1,602,592, 1,623,499 and 3,297,446.

The amount of selenium sensitizer used varies according to the selenium compound which is being used, the silver halide grains and chemical ripening for example. But in general, an amount of from about $10^{-8}$ to about $10^{-4}$ mol, and preferably of from $10^{-7}$ mol to $10^{-5}$ mol, per mol of silver halide is used. The preferred time for the addition of a selenium sensitizer is after grain formation and especially after de-salting.

Compounds represented by formula (II) or (III) of the present invention can be prepared on the basis of the methods disclosed, for example, by F. M. Hamer in *Heterocyclic Compounds—Cyanine Dyes and Related Compounds*, published by John Wiley & Sons, New York, London 1964, by D. M. Sturmer in *Heterocyclic Compounds Special—Topics in Heterocyclic Chemistry*, Chapter 18, Section 14, pages 482 to 515 (published by John Wiley & Sons, New York, London, 1977), and in *Rodd's Chemistry of Carbon Compounds* (2nd Ed., Vol. IV, part B, published 1977) Chapter 15, pages 369 to 422 and (2nd Ed., Vol. IV, Part B, published 1985) Chapter 15, pages 267 to 296 (Published by Elsvier Science Publishing Company Inc., New York).

An example of the preparation of Compound II-1 is described below.

2,6-Dimethylquinoline (72.3 grams, 0.46 mol) and 188 grams (1.4 mol) of butanesulfone were heated and stirred together for 4 hours at 145° C. and then cooled to room temperature. After which 500 ml of acetone was added and the mixture was crystallized for 30 minutes with ice cooling. The crystals which were filtered off, washed with acetone, and then dried; and 127.3 grams of 4-[2,6-dimethyl-l-quinoline]butanesulfonate were obtained (yield 94%).

Next, 102.6 grams (0.36 mol) of 4-[2,6-dimethyl-1-quinoline]butanesulfonate and 166 grams (0.35 mol) of 4-[5-chloro-2-(4-sulfobutylthio)benzothiazolio]butanesulfonate were suspended in 1000 ml of ethanol, 102 ml (0.73 mol) of triethylamine were added. On heating under reflux for 30 minutes, crude crystals of Compound II-1 were precipitated out. The crude crystals which had been recovered by filtration were dissolved in 200 ml of methanol. Acetone was added and the crystals were precipitated. The crystals so obtained were concentrated and recrystallized from methanol, and 124 grams of Compound II-1 of HPLC purity 99.9% were obtained (yield 51%).

$\lambda_{max}$(methanol)=489.7 nm m.p.>300° C.

For inclusion in a silver halide emulsion, the spectrally sensitizing dyes may be dispersed directly in the emulsion or they may be dissolved in an individual solvent such as water, methanol, ethanol, propanol, methylcellosolve or 2,2,3,3-tetrafluoropropanol or in a mixture of solvents for addition to the emulsion. Furthermore, they may be formed into aqueous solutions in the presence of acids or bases as disclosed, for example, in JP-B-44-23389, JP-B-44-27555 or JP-B-57-22089, or they can be formed into an aqueous solution or a colloidal dispersion in the presence of a surfactant, as disclosed for example in U.S. Pat. Nos. 3,822,135 and 4,006,025, for addition to the emulsion. Furthermore, they may be dissolved in a solvent which is essentially immiscible with water such as phenoxyethanol for example and then dispersed in water or in a hydrophilic colloid for addition to the emulsion. They may also by dispersed directly in a hydrophilic colloid as disclosed in JP-A-53-102733 and JP-A-58-105141 and the dispersion may be added to the emulsion.

The time at which the addition to the emulsion is made may be at any stage during manufacture which has been known to be useful in the past. Thus, the time can be before the formation of the grains of the silver halide emulsion, during grain formation, before the washing process immediately after grain formation, before chemical sensitization, during chemical sensitization, before cooling and solidifying the emulsion immediately after chemical sensitization, or during the preparation of a coating liquid. The addition is usually made at a time after the completion of chemical sensitization and before coating. But the addition can be made at the same time as the chemical sensitizers as disclosed in U.S. Pat. Nos. 3,628,969 and 4,225,666, and spectral sensitization can be carried out at the same time as chemical sensitization, or the addition can be made before chemical sensitization as disclosed in JP-A-58-113928. The addition can also be made and spectral sensitization can be started before the precipitation and formation of the silver halide grains has been completed. Moreover, the addition can be made by dividing the spectrally sensitizing dye, which is to say, with the addition of some of the dye before chemical sensitization and the remainder being added after chemical sensitization, as disclosed in U.S. Pat. No. 4,225,666, and the addition can be made at any time during the formation of the silver halide grains based on the method described in U.S. Pat. No. 4,183,756. From among these methods, the addition of the sensitizing dye before washing the emulsion or before chemical sensitization is especially desirable.

The amounts in which these spectrally sensitizing dyes are added vary over a wide range depending on the particular case, but the amount is preferably in the range from $0.5\times10^{-6}$ mol to $1.0\times10^{-2}$ mol per mol of silver halide. It is most desirably in the range from $1.0\times10^{-6}$mol to $5.0\times10^{-3}$ mol per mol of silver halide.

In the present invention the green light photosensitive silver halide emulsion is selenium sensitized, and those cases wherein that same emulsion is also spectrally sensitized with a sensitizing dye represented by formula (II) are preferred.

The silver halide emulsion which is selenium sensitized in accordance with the present invention is preferably a silver bromide, silver iodobromide, silver iodochlorobromide, silver chlorobromide or silver chloride emulsion.

The silver halide grains which have been selenium sensitized in accordance with the present invention may have a regular crystalline form such as a cubic or octahedral form, an irregular crystalline form such as a spherical or plate-like form, or a crystalline form which is a composite of these crystalline forms. Use can also be made of mixtures of grains which have various crystalline forms, but the use of grains which have a regular crystalline form is preferred.

The silver halide grains which have been selenium sensitized in accordance with the present invention may be such that the interior and surface layer form different phases, or they may comprise a uniform phase. Furthermore, the grains may be of the type with which a latent image is formed principally on the surface (for example a negative type emulsion) or they may be of the type in which a latent image is formed principally within the grains (for example, internal latent image type emulsions and pre-fogged direct reversal type emulsions). Grains of the type with which a latent image is formed principally on the surface are preferred.

The silver halide emulsions used in the present invention are preferably tabular grain emulsions in which grains of a thickness of not more than 0.5 microns, and preferably of not more than 0.3 microns, and diameter preferably of at least 0.6 microns and which have an average aspect ratio of at least 3 account for at least 50% of the total projected area. Or monodisperse emulsions in which the statistical variation coefficient (the value of the ratio S/d obtained by dividing the standard deviation S by the diameter d in a distribution in which the projected areas are represented by the diameter in cases where they are approximately circular) is less than 20%, are preferred. Furthermore, two or more types of tabular gain emulsion and monodisperse emulsion can be used in the form of mixtures.

Photographic emulsions which can be used in the invention can be prepared, for example, using the methods disclosed by P. Glafkides in *Chimie et Physique Photographique*, published by Paul Montel, 1967, by G. F. Duffin in *Photographic Emulsion Chemistry*, published by Focal Press, 1966, and by V. L. Zelikman et al. in *Making and Coating Photographic Emulsion*, published by Focal Press, 1964.

Furthermore, silver halide solvents, for example ammonia, potassium thiocyanate, ammonium thiocyanate, thioether compounds (for example, those disclosed in U.S. Pat. Nos. 3,271,157, 3,574,628, 3,704,130, 4,297,439 and 4,276,374), thione compounds (for example, those disclosed in JP-A-53-144319, JP-A-53-82408 and JP-A-55-77737) and amine compounds (for example, those disclosed in JP-A-54-100717) can be used to control grain growth during the formation of the silver halide grains.

Cadmium salts, zinc salts, thallium salts, iridium salts or complex salts thereof, rhodium salts or complex salts thereof and iron salts or complex salts thereof, for example, may be present during the formation or physical ripening of the silver halide grains.

In those cases where silver iodobromide or silver iodochlorobromide is used for the emulsion of a photosensitive material of the present invention, the relative standard deviation of the silver iodide contents of the individual silver halide grains in the emulsion is preferably not more than 20% for each emulsion. If the above-mentioned relative standard deviation exceeds 20%, the fog level tends to increase and the gradation tends to deteriorate, which is undesirable.

Practical methods for measuring the silver iodide contents of individual grains have been disclosed in Japanese Patent Application Nos. 63-325383 and 1-045724 (each corresponding to JP-A-2-256043).

The silver halide photographic emulsions which can be used conjointly in a photosensitive material of the present invention can be prepared, for example, using the methods disclosed in *Research Disclosure* (RD) No. 17643 (December, 1978), pages 22 to 23, "I. Emulsion Preparation and Types" and *Research Disclosure* No. 18716 (November 1979), page 648, by P. Glafkides in *Chimie et Physique Photographique*, published by Paul Montel, 1967, by G. F. Duffin in *Photographic Emulsion Chemistry*, published by Focal Press, 1966, and by V. L. Zelikman et al. in *Making and Coating Photographic Emulsions*, published by Focal Press, 1964.

The monodisperse emulsions disclosed, for example, in U.S. Pat. Nos. 3,574,628 and 3,655,394, and British Patent 1,413,748 are preferred.

The crystal structure may be uniform, or the inner and outer parts may have a heterogeneous halogen composition, or it may be a layer-like structure. Silver halides which have different compositions may be joined with an epitaxial junction, and they may be joined with compounds other than silver halides such as silver thiocyanate or lead oxide.

Mixtures of grains which have various crystalline forms can also be used.

The silver halide emulsion layers which are used are generally subjected to physical ripening, chemical ripening and spectral sensitization. Additives which can be used in such processes have been disclosed in *Research Disclosure* No. 17643 and *Research Disclosure* No. 18716, and the locations of these disclosures are summarized in the table below.

Known photographically useful additives which can be used in the present invention are also disclosed in the two *Research Disclosures* referred to above, and the locations of these disclosures are also indicated in the table below.

| Type of Additive | RD No. 17643 | RD No. 18716 |
|---|---|---|
| 1. Chemical sensitizers | Page 23 | Page 648, right col. |
| 2. Speed increasing agents | | As above |
| 3. Spectral sensitizers, supersensitizers | Pages 23–24 | Pages 648 right col. to 649 right col. |
| 4. Whiteners | Page 24 | |
| 5. Anti-foggants and stabilizers | Pages 24–25 | Page 649, right col. |
| 6. Light absorbers, filter dyes and ultraviolet absorbers | Pages 25–26 | Page 649, right col. - page 650, left col. |
| 7. Anti-staining agents | Page 25, right col. | Page 650, left - right cols. |
| 8. Dye image stabilizers | Page 25 | |
| 9. Hardening agents | Page 26 | Page 651, left col. |
| 10. Binders | Page 26 | As above |
| 11. Plasticizers, lubricants | Page 27 | Page 650, right col. |
| 12. Coating promotors and surfactants | Pages 26–27 | Page 650, right col. |
| 13. Anti-static agents | Page 27 | As above |

Various color couplers can be used in the present invention, and examples have been disclosed in the patents disclosed in the aforementioned *Research Disclosure* (RD) No. 17643, VII-C to G. Couplers which provide the colored images of a three primary color for subtractive color process (for example yellow, magenta and cyan) on color development are important as dye forming couplers. In addition to the couplers disclosed in the patents disclosed in the aforementioned RD No. 17643, VII-C and D, those indicated below can be used desirably in the present invention as examples of four-equivalent and two-equivalent couplers which are fast to diffusion.

The hydrophobic acylacetamide based couplers, having ballast groups, are typical of the yellow couplers which can be used in the present invention. Examples have been disclosed, for example, in U.S. Pat. Nos. 2,407,210, 2,875,057 and 3,265,506. The use of two-equivalent yellow couplers is preferred in the present invention, and typical examples include the oxygen atom elimination type yellow couplers disclosed, for example, in U.S. Pat. Nos. 3,408,194, 3,447,928, 3,933,501 and 4,022,620, and the nitrogen atom elimination type yellow couplers disclosed, for example, in JP-B-58-10739, U.S. Pat. Nos. 4,401,752 and 4,326,024, RD No. 18053 (April 1979), British Patent 1,425,020 and West German Patent Application (OLS) Nos. 2,219,917, 2,261,361, 2,329,587 and 2,433,812. Moreover, α-pivaloylacetanilide based couplers form dyes which have excellent fastness, especially light fastness, while α-benzoylacetanilide based couplers provide high color forming densities.

Hydrophobic indazolone based or cyanoacetyl based couplers, and preferably 5-pyrazolone based and pyrazoloazole based couplers, having ballast groups, can be cited as magenta couplers which can be used in the present invention. The 5-pyrazolone based couplers are preferably couplers which have an arylamino group or an acylamino group substituted in the 3-position, from the point of view of the hue of the dye which is formed and the color forming density. Typical examples have been disclosed, for example, in U.S. Pat. Nos. 2,311,082, 2,343,703, 2,600,788, 2,908,573, 3,062,653, 3,152,896 and 3,936,015. The nitrogen atom leaving groups disclosed in U.S. Pat. No. 4,310,619 or the arylthio groups disclosed in U.S. Pat. No. 4,351,897 are especially desirable as the leaving groups of two-equivalent 5-pyrazolone based couplers. Furthermore, the 5-pyrazolone based couplers which have ballast groups disclosed in European Patent 73,636 provide high color forming densities. The pyrazolobenzimidazoles disclosed in U.S. Pat. No. 3,369,879, and preferably the pyrazolo[5,1-cl-[1,2,4]triazoles disclosed in U.S. Pat. No. 3,725,067, the pyrazolotetrazoles disclosed in *Research Disclosure* No. 24220 (June 1984) and JP-A-60-33552, and the pyrazolo-pyrazoles disclosed in *Research Disclosure* No. 24230 (June 1984) and JP-A-60-43659 can be cited as pyrazoloazole based couplers. The imidazo[1,2-b]-pyrazoles disclosed in U.S. Pat. No. 4,500,630 are preferred in view of the slight absorbance on the yellow side and the light fastness of the colored dye which is formed, and the pyrazolo[1,5-b][1,2,4]triazole disclosed in European Patent 119,860A is especially desirable.

The hydrophobic naphthol based couplers and phenol based couplers which are fast to diffusion are cyan couplers which can be used in the present invention. Typical examples include the naphthol based couplers disclosed in U.S. Pat. No. 2,474,293 and, preferably, the oxygen atom elimination type two-equivalent naphthol based couplers disclosed in U.S. Pat. Nos. 4,052,212, 4,146,396, 4,228,233 and 4,296,200. Furthermore, examples of phenol based couplers have been disclosed, for example, in U.S. Pat. Nos. 2,369,929, 2,801,171, 2,772,162 and 2,895,826. The use of cyan couplers which are fast to humidity and temperature is preferred in the present invention. Typical examples of such couplers include the phenol based cyan couplers which have an alkyl group comprising an ethyl or larger group in the meta position of the phenol ring disclosed in U.S. Pat. No. 3,772,002, the 2,5-diacylamino substituted phenol based couplers disclosed, for example, in U.S. Pat. Nos. 2,772,162, 3,758,308, 4,126,396, 4,334,011 and 4,327,173, West German Patent Application (OLS) No. 3,326,729 and European Patent 121,365, and the phenol based couplers which have a phenylureido group in the 2-position and an acylamino group in the 5-position disclosed, for example, in U.S. Pat. Nos. 3,446,622, 4,333,999, 4,451,559 and 4,427,767.

The conjoint use of colored couplers and masking is desirable in color photosensitive materials for photographing for correcting the unwanted absorptions of the color forming dyes. Typical examples include the yellow colored magenta couplers disclosed, for example, in U.S. Pat. No. 4,163,670 and JP-B-57-39413, and the magenta colored cyan couplers disclosed, for example, in U.S. Pat. Nos. 4,004,929 and 4,138,253 and British Patent 1,146,368. Other colored couplers have been disclosed in the aforementioned RD No. 17643, section VII-G.

Graininess can be improved by the conjoint use of couplers for which the color forming dyes have suitable diffusion properties. Examples of couplers of this type include the magenta couplers disclosed in U.S. Pat. No. 4,366,237 and British Patent 2,125,570, and the yellow, magenta and cyan couplers disclosed in European Patent 96,570 and West German Patent Application (OLS) No. 3,234,533.

The dye forming couplers and the above mentioned special couplers can take the form of dimers or larger polymers. Typical examples of polymerized dye forming couplers have been disclosed in U.S. Pat. Nos. 3,451,820 and 4,080,211. Examples of polymerized magenta couplers have been disclosed in British Patent 2,102,173 and U.S. Pat. No. 4,367,282.

Couplers which release a photographically useful group on coupling can also be used desirably as polymers. Useful DIR couplers which release development inhibitors have been disclosed in the patents disclosed in the aforementioned RD No. 17643, section VII-F.

Those preferred for use in the present invention are the developer deactivating type as typified by those disclosed in JP-A-57-151944, the timing type as typified by those disclosed in U.S. Pat. No. 4,248,962 and JP-A-57-154234 and the reactive type as typified by those disclosed in JP-A-60-184248. The developer deactivating type DIR couplers disclosed for example in JP-A-57-151944, JP-A-58-217932, JP-A-60-218644, JP-A-60-225156 and JP-A-60-233650 and the reactive type DIR couplers disclosed in JP-A-60-184248 are especially desirable.

Suitable supports which can be used for photographic photosensitive materials which have a photographic emulsion of the present invention have been disclosed on page 28 of the aforementioned RD No. 17643 and from the right hand column on page 647 to the left hand column on page 648 of RD No. 18716.

Various color and black-and-white photosensitive materials can be cited as photographic photosensitive materials in which photographic emulsions of the present invention can be used. For example, color negative films for photographing (for example for general use and for cinema purposes), color reversal films (for example for slides or cinema purposes, in both cases where couplers are included and where they are not included), color printing papers, color positive films (for example for cinema purposes), color reversal printing papers, heat-developable color photosensitive materials, color photosensitive materials for use with the silver dye bleach method, photographic photosensitive materials for photomechanical process (lith films, scanner films and the like), X-ray photographic photosensitive materials (direct and indirect medical use and industrial use for example), black-and-white negative films for photographing, black-and-white printing papers, photosensitive materials for micro applications (for COM purposes, microfilms and the like), color diffusion transfer photosensitive materials (DTR), silver salt diffusion transfer photosensitive materials and print-out photosensitive materials can be cited.

The exposure for obtaining a photographic image with a photographic photosensitive material in which a photographic emulsion of the present invention is used can be carried out using normal methods. That is to say, the exposure can be made using various known light sources, including infrared light, such as natural light (daylight), tungsten lamps, fluorescent lamps, mercury lamps, xenon arc lamps, carbon arc lamps, xenon flash lamps, cathode ray tube flying spots, light emitting diodes and laser light (for example, gas lasers, YAG lasers, dye lasers, semiconductor lasers and second harmonics of the light of these lasers). Furthermore, exposures can also be made using the light released from phosphors which have been excited with electron beams, X-rays, $\gamma$-rays or $\alpha$-rays for example. An exposure time ranging from 1/1000th of a second to 1 second as used in a normal camera can of course be used, and exposures shorter than 1/1000th of a second, such as exposures made using a xenon strobe light or a cathode ray tube with an exposure time of from $1/10^4$ to $1/10^6$ second for example, and exposures of a duration longer than 1 second can also be used. The spectral composition of the light which is used for the exposure can be adjusted with color filters, as required.

The photographic photosensitive materials in which a photographic emulsion of the present invention can be used can be developed and processed using the usual methods disclosed on pages 28 to 29 of the aforementioned RD No. 17643 and from the left hand column to the right hand column on page 651 of the aforementioned RD No. 18716.

Known aromatic primary amine color developing agents are included in the color developers which are used in the present invention. The p-phenylenediamine derivatives are preferred and typical examples are indicated below, but the developing agent is not limited by these examples:

D-1 N,N-Diethyl-p-phenylenediamine
D-2 2-Amino-5-diethylaminotoluene
D-3 2-Amino-5-(N-ethyl-N-laurylamino)toluene
D-4 4-[N-ethyl-N-($\beta$-hydroxyethyl)amino]aniline
D-5 2-Methyl-4-[N-ethyl-N-($\beta$-hydroxyethyl-)amino]aniline
D-6 4-Amino-3-methyl-N-ethyl-N-[$\beta$-(methanesulfonamido)ethyl]aniline
D-7 N-(2-Amino-5-diethylaminophenylethyl)methanesulfonamide
D-8 N,N-Dimethyl-p-phenylenediamine
D-9 4-Amino-3-methyl-N-ethyl-N-methoxyethylaniline
D-10 4-Amino-3-methyl-N-ethyl-N-$\beta$-ethoxyethylaniline
D-11 4-Amino-3-methyl-N-ethyl-N-$\beta$-butoxyethylaniline The use of illustrative compound D-5 from among the p-phenylenediamine derivatives indicated above is preferred.

Furthermore, these p-phenylenediamine derivatives may take the form of salts, such as sulfates, hydrochlorides, sulfites or p-toluenesulfonates for example.

The abovementioned color developing agents are used in amounts within the range from 0.013 mol to 0.065 mol per liter of color developer, and preferably in amounts of from 0.016 mol to 0.048 mol, and most desirably in amounts of from 0.019 mol to about 0.032 mol, per liter of color developer, from the viewpoint of achieving more rapid processing.

Furthermore sulfites, such as sodium sulfite, potassium sulfite, sodium bisulfite, potassium bisulfite, sodium metabisulfite and potassium metabisulfite, and carbonyl/sulfurous acid adducts, can be added to the color developer, as required, as preservatives.

The preferred amount of preservative added is from 0.5 to 10 grams, and most desirably from 1 to 5 grams, per liter of color developer.

Furthermore, the addition of various hydroxylamines (for example, the compounds disclosed in JP-A-63-5341 and JP-A-63-106655, from among which the compounds which have sulfo groups or carboxy groups are preferred), the hydroxamic acids disclosed in JP-A-63-43138, the hydrazines and hydrazides disclosed in JP-A-63-146041, the phenols disclosed in JP-A-63-44657 and JP-A-63-58443, the α-hydroxyketones and α-aminoketones disclosed in JP-A-63-44656 and/or the various sugars disclosed in JP-A-63-36244, as compounds which preserve directly the aforementioned aromatic primary amine color developing agents-is desirable. Furthermore, the conjoint use with the abovementioned compounds of the mono-amines disclosed, for example, in JP-A-63-4235, JP-A-63-24254, JP-A-63-21647, JP-A-63-146040, JP-A-63-27841 and JP-A-63-25654, the di-amines disclosed, for example, in JP-A-63-30845, JP-A-63-14640 and JP-A-63-43139, the polyamines disclosed, for example, in JP-A-63-21647, JP-A-63-26655 and JP-A-63-44655, the nitroxy radicals disclosed in JP-A-63-53551, the alcohols disclosed in JP-A-63-43140 and JP-A-63-53549, the oximes disclosed in JP-A-63-56654 and the tertiary amines disclosed in JP-A-63-239447, is desirable.

Other preservatives, such as the various metals disclosed in JP-A-57-44148 and JP-A-57-53749, the salicylic acids disclosed in JP-A-59-180588, the alkanolamines disclosed in JP-A-54-3582, the polyethyleneimines disclosed in JP-A-56-94349 and the aromatic polyhydroxy compounds disclosed in U.S. Pat. No. 3,746,544, for example, can be included as required. The addition of aromatic hydroxy compounds is especially desirable.

In the present invention the pH of the color developer is set within the range 9.5 to 12, but a pH of at least 10.2 is preferred, and a pH of 10.5 to 11.5 is most desirable, from the point of view of achieving rapid processing.

It is possible to accelerate both silver development and the color forming reaction by raising the pH, and this is especially effective for accelerating the formation of cyan dyes.

Increasing the amount of alkali metal hydroxide such as potassium hydroxide or sodium hydroxide which is added and also increasing the amount of alkali buffer such as potassium carbonate or tri-sodium phosphate is desirable for raising the pH. The amount of such a buffer is from 0.2 mol to 1.0 mol, preferably from 0.3 mol to 0.8 mol, and most desirably from 0.35 mol to 0.5 mol, per liter of developer.

The development process may be carried out in two or more baths which have different pH values. For example, it is possible to adjust the balance of the rate of development of the upper layer and the lower layer by processing for a short time in a first bath with a developer of a pH not more than 9 and then processing in a developer of a high pH above 10.5.

The use of various buffers is desirable for maintaining the abovementioned pH.

Examples of buffers include sodium carbonate, potassium carbonate, sodium bicarbonate, potassium bicarbonate, tri-sodium phosphate, tri-potassium phosphate, di-sodium phosphate, di-potassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate) and potassium 5-sulfo-2-hydroxybenzoate (potassium 5-sulfosalicylate). However, the present invention is not limited to these compounds.

The amount of buffer which is added to the color developer is preferably at least 0.1 mol/liter, and most desirably it is from 0.1 to 0.4 mol/liter.

In addition, various chelating agents can be used in the color developer as agents for preventing the precipitation of calcium and magnesium or for improving the stability of the color developer.

Organic acid compounds are preferred as chelating agents. Examples include aminopolycarboxylic acids, organic phosphonic acids and phosphonocarboxylic acids. Typical examples of these include nitrilotriacetic acid, diethylenetriamine pentaacetic acid, ethylenediamine tetraacetic acid, N,N,N-trimethylenephosphonic acid, ethylenediamine-N,N,N'N'-tetramethylenephosphonic acid, transcyclohexanediamine tetraacetic acid, 1,2-diaminopropane tetraacetic acid, hydroxyethylimino diacetic acid, glycol ether diamine tetraacetic acid, ethylenediamine o-hydroxyphenylacetic acid, 2-phosphonobutane-1,2,4-tricarboxylic acid, 1-hydroxyethylidene-1,1-diphosphonic acid and N,N'-bis(2-hydroxybenzyl)-ethylene-diamine-N,N'-diacetic acid. Two or more of these chelating agents may be used conjointly, as required. The amounts of these chelating agents which are added should be sufficient to chelate the metal ions which are present in the color developer. For example, they are used in amounts of from 0.1 gram to 10 grams per liter.

Not more than 0.02 mol/liter of bromide can be added to the color developer as required for preventing the occurrence of fogging and for controlling gradation for example. But an amount of not more than 0.015 mol/liter is desirable from the point of view of achieving rapid development. The use of alkali metal bromides such as potassium bromide, sodium bromide, lithium bromide and the like for the abovementioned bromide is preferred.

Furthermore, various anti-foggants can also be used to prevent fogging and to improve discrimination. Examples of preferred anti-foggants include the organic anti-foggants disclosed on pages 39 to 42 of *Photographic Processing Chemistry*, (second edition, published 1975) by L. F. A. Mason, such as benzotriazole, 5-methylbenzotriazole, 6-nitrobenzimidazole, 5-phenyltetrazole, 1-phenyl-5-mercaptotetrazole and the like. These are also preferably used in the amounts disclosed in the abovementioned publication.

Furthermore, the 4-hydroxy-6-methyl-1,3,3a,7-tetraazaindene and the like disclosed on pages 398 to 399 of The *Theory of the Photographic Process* (fourth edition) by T. H. James are also desirable, and the amounts used are the same as for the aforementioned anti-foggants.

The use of various development accelerators in the color developer is also desirable from the viewpoint of achieving rapid development. The compounds disclosed on pages 41 to 44 of the aforementioned book by L. F. A. Mason and the conjoint use of the various black-and-white developing agents disclosed on pages 15 to 29 of the same book can be cited as such development accelerators. Among these, the pyrazolidones such as 1-phenyl-3-pyrazolidone, the p-aminophenols and tetramethyl-p-phenylenediamine, for example, are especially desirable.

The preferred amount of these development accelerators in use is from 0.001 gram to 0.1 gram, and most desirably from 0.003 gram to 0.05 gram, per liter of developer.

Brightening agents may also be included in the color developers which can be used in the present invention. 4,4'-Diamino-2,2'-disulfostilbene based compounds are preferred as brightening agents. The amount used is from 0 to 5 grams/liter, and preferably from 0.1 to 4 grams/liter.

Furthermore, various surfactants such as alkylsulfonic acids, arylsulfonic acids, aliphatic carboxylic acids and aromatic carboxylic acids, for example, may be added as required.

The processing temperature in the color developer in the present invention is from 20° to 50° C., and preferably from 30° to 45° C. The processing time is from 20 seconds to 5 minutes, preferably from 30 seconds to 3 minutes 20 seconds, and most desirably from 1 minute to 2 minutes 30 seconds.

The present invention is preferably processed with a color development time of not more than 150 seconds. Here, the development time is the period of time from the initial immersion of the leading edge of the photosensitive material in the color developer up to the initial immersion in the processing liquid of the next process, and it includes the in-air time while the material is being carried between processes.

The in-air time is generally from 1 second to 30 seconds, but a short in-air time is desirable for achieving the rapid processing which is the aim of the present invention. In practical terms, it is preferably not more than 15 seconds and most desirably not more than 10 seconds.

The effect of the present invention is more pronounced with short time processing, and from this viewpoint not more than 120 seconds is preferred, and not more than 100 seconds is most desirable.

Furthermore, the color development bath can be divided into two or more baths, as required, with replenishment with color developer replenisher from the first bath or the last bath. A shortening of the processing time and a reduction of the replenishment rate can be achieved in this way.

The method of processing of the present invention can also be used for color reversal processing. The black-and-white developers known as first developers which can be used in reversal processing of color photosensitive materials can be used for black-and-white developer at this time. Various well known additives which are added to and used in black-and-white developers which are used as processing liquids for black-and-white silver halide photosensitive materials can be included.

Developing agents such as 1-phenyl-3-pyrazolidone, Metol and hydroquinone, preservatives such as sulfite, accelerators consisting of alkali such as sodium hydroxide, sodium carbonate and potassium carbonate, inorganic or organic restrainers such as potassium bromide, 2-methylbenzimidazole and methylbenzthiazole, water softening agents such as polyphosphoric acid and development inhibitors such as trace amounts of iodide or mercapto compounds can be cited as typical additives.

When processing is carried out in an automatic processor using the abovementioned developer, it is desirable that the area (open area) over which the developer is in contact with the air should be as small as possible. For example, if the value obtained by dividing the open area ($cm^2$) by the volume of the developer ($cm^3$) is taken as the open factor, the open factor is preferably not more than 0.01, and most desirably not more than 0.005.

Furthermore, the addition of water corresponding to the extent of evaporation is desirable for correcting the concentration of the developer which arises as a result of evaporation.

The present invention is also effective in cases where the developer is regenerated.

The color developer in the present invention is preferably used continuously with supplying replenisher. The replenisher contains components in amounts required to replace the components which have been consumed by development and the components which have been consumed by the passage of time. Hence, in general, the components included are somewhat larger amount than in the parent developer. The ratio is generally such that the amounts are some 10 to 50% larger than in the parent bath.

However, bromide is leached out from the photosensitive material in the course of development. So it is desirable that the bromide content of the replenisher be set to a low level when compared with that in the parent bath, and it is desirable that it be reduced as the rate of replenishment is reduced. For example, in a case where the rate of replenishment per square meter of photosensitive material is not more than 700 ml, the bromide content is preferably not more than 0.004 mol per liter. In a case where the replenishment rate is not more than 500 ml it is preferably not more than 0.003 mol. Moreover, in cases where the replenishment rate is reduced further the replenisher preferably contains no bromide at all.

The color developer is prepared by dissolving the compounds indicated above in water. The water which is used is preferably soft water. Water of conductivity not more than 10 μs/cm which has been distilled or deionized by treatment with an ion exchange resin or a reverse osmosis membrane is preferred.

The pH value of these color developers is generally from 9 to 12. Furthermore, the replenishment rate of the developer also depends on the color photographic photosensitive material which is being processed. But, in general, it is not more than 3 liters per square meter of photosensitive material, and it can be set to not more than 500 ml per square meter of photosensitive material by reducing the bromide ion concentration of the replenisher. It is desirable that evaporation and aerial oxidation of the liquid be prevented by minimizing the contact area with the air in the processing tank in cases where the rate of replenishment is reduced. The replenishment rate can be further reduced by using some means of preventing the accumulation of bromide ion in the developer.

The photographic emulsion layer is generally subjected to a bleaching process after color development. The bleaching process may be carried out at the same time as a fixing process (in a bleach-fix process) or it may be carried out separately. Moreover, a method of processing in which bleach-fixing is carried out after a bleaching process may be used in order to speed up processing. Moreover, processing can be carried out with two connected bleach-fix baths, a fixing process can be carried out prior to a bleach-fix process, or a bleaching process may be carried out after a bleach-fix process, in accordance with the intended purpose of the processing.

Compounds of poly-valent metals, such as iron(III), cobalt(III), chromium(VI) and copper(II) for example, peracids, quinones and nitro compounds, for example, can be used as bleaching agents. Thus, for example, ferricyanide; dichromate; organic complex salts of iron(III) or cobalt(III), for example complex salts with aminopolycarboxylic acids such as ethylenediamine tetraacetic acid, diethylenetriamine pentaacetic acid, cyclohexanediamine tetraacetic acid, methylimino diacetic acid, 1,3-diaminopropane tetraacetic acid and glycol ether diamine tetraacetic acid, or with citric acid, tartaric acid or malic acid for example; persulfate; bromate; permanganate and nitrobenzenes, can be used as typical bleaching agents. Of these, the aminopolycarboxylic acid iron(III) complex salts, starting with ethylenediamine tetraacetic acid iron(III) complex salts, and persulfate are preferred to achieve rapid processing and to prevent environmental pollution. Moreover, the aminopolycarboxylic acid iron(III) complex salts are effective in both bleach baths and bleach-fix baths. The pH of a bleach or bleach-fix in which these aminopolycarboxylic acid iron(III) complex salts are used is generally from 5.5 to 8, but processing can be carried out at lower pH values in order to speed up processing.

Bleaching accelerators can be used, as required, in bleach baths, bleach-fix baths, or bleach or bleach-fix pre-baths. Examples of useful bleach accelerators have been disclosed in the following specifications: the compounds which have a mercapto group or a disulfide bond disclosed, for example, in U.S. Pat. No. 3,893,858, West German Patent 1,290,812, JP-A-53-95630 and *Research Disclosure* No. 17129 (July 1978); the thiazolidine derivatives disclosed in JP-A-50-140129; the thiourea derivatives disclosed in U.S. Pat. No. 3,706,561; the iodides disclosed in JP-A-58-16235; the polyoxyethylene compounds disclosed in West German Patent 2,748,430; the polyamine compounds disclosed in JP-B-45-8836 and bromide ion. Among these compounds, those which have a mercapto group or a disulfide group are preferred from the viewpoint of their large accelerating effect, and the compounds disclosed in U.S. Pat. No. 3,893,858, West German Patent 1,290,812 and JP-A-53-95630 are especially desirable. Moreover, the compounds disclosed in U.S. Pat. No. 4,552,834 are also desirable. These bleaching accelerators may be added to the photosensitive material. These bleaching accelerators are especially effective when bleach-fixing color photosensitive materials for photographing.

Thiosulfate, thiocyanate, thioether based compounds, thioureas and large amounts of iodide can be cited, for example, as fixing agents. But thiosulfate is generally used, and ammonium thiosulfate in particular can be used in the widest range of applications. Sulfite, bisulfite, sulfinic acids or carbonyl/bisulfite addition compounds are preferred as preservatives for bleach-fix baths.

Processes such as water washing and stabilization are carried out after bleach-fix processing. Depending on the type and application of the photosensitive material, it is sometimes dried immediately after water washing, while sometimes it is treated with a stabilizer before drying, or the material can be treated directly with a stabilizer without water washing and then dried. Any of these methods can be selected.

The water washing bath which is used in the present invention is preferably water, such as tap water, well water, distilled water or deionized water for example. But various known compounds such as sodium sulfate and magnesium chloride can be added in order to increase the washing effect. The pH of the water-washing bath is generally from 5 to 8, but there are also cases where it is adjusted to be acidic at pH below 5 or alkaline at pH above 8 in order to accelerate washing. Furthermore, anionic or cationic surfactants can also be added as another means of accelerating washing. Moreover, the compounds disclosed in *J. Antibact. Antifung. Agents*, Vol. 11, No. 5, pages 207 to 223 (1983) and by Hiroshi Horiguchi in *The Chemistry of Biocides and Fungicides* can also be added. An excellent effect in terms of preventing degeneration of water during storage is provided by the active halogen releasing compounds typified by sodium dichloroisocyanurate, the triazole derivatives typified by benzotriazole, and the isothiazoline based compounds typified by 5-chloro-2-methyl-4-isothiazolin-3-one. In addition, water softening agents such as ethylenediamine tetraacetic acid and nitrilotriacetic acid can also be used.

All the compounds which can be added to the water washing bath can be added to a stabilizing bath, and compounds which have an image stabilizing effect can also be added. Aldehyde compounds as typified by formaldehyde, ammonium compounds such as ammonium chloride and brightening agents can be cited as examples. The pH of the stabilizer is generally from 4 to 8, but there are also cases where the use of a lower pH range of from 3 to 5 is desirable, depending on the type and purpose of the photosensitive material.

The invention is described in more detail below by means of examples.

EXAMPLE 1

A solution of silver nitrate and a mixed solution of potassium iodide and potassium bromide were added with agitation using the double jet method to a solution which was being maintained at 70° C. which had been obtained by dissolving potassium bromide, thioether ($HO(CH_2)_2S(CH_2)_2S(CH_2)_2OH$) and gelatin.

The temperature was lowered to 35° C. after the addition had been completed. After removing the soluble salts with the usual flocculation method, the temperature was raised to 40° C., 60 grams of gelatin was added and dissolved, and the pH was adjusted to 6.8.

The tabular silver halide grains obtained had an average diameter of 1.25 μm, a thickness of 0.17 μm, an average diameter/thickness ratio of 7.4 and contained 3 mol% silver iodide. Furthermore, the pAg value at 40° C. was 8.4.

This emulsion was divided into twelve portions, the temperature was raised to 62° C., and the sensitizing dye shown in Table 1 (500 mg/molAgX) and potassium iodide (200 mg/molAgX) were added. Then, the sensitizers shown in Table 1 were added, and chloroauric acid ($9\times10^{-6}$ mol/molAgX) and potassium thiocyanate ($3.2\times10^{-4}$ mol/molAgX) were added, and 1-(3-sulfophenyl)-5-mercaptotetrazole sodium salt was added. The emulsions were chemically ripened for 30 minutes.

After the chemical sensitization had been completed, 100 grams of each emulsion (containing 0.08 mol of silver) was dissolved at 40° C., and coating liquids were prepared by adding sequentially the components (i) to (iv) indicated below:

| | | |
|---|---|---|
| (i) | 4-Hydroxy-6-methyl-1,3,3a,7-tetraaza-indene | 3% aqueous solution 2 cc |
| (ii) | $C_{17}H_{35}$—O—$(CH_2CH_2O)_{25}$—H | 2% aqueous solution 2.2 cc |
| (iii) | Compound (A-1) | 2% aqueous solution 1.6 cc |
| (iv) | 2,4-Dichloro-6-hydroxy-s-triazine sodium salt | 2% aqueous solution 3 cc |

A surface protecting layer coating liquid was prepared by adding sequentially the components (i) to (v) indicated below with agitation at 40° C.:

| | | |
|---|---|---|
| (i) | 14% Aqueous gelatin solution | 56.8 g |
| (ii) | Fine poly(methyl methacrylate) particles (average particle size 3.0 μm) | 3.9 g |
| (iii) | Emulsion | |
| | Gelatin 10% aqueous solution | 4.24 g |
| | Compound (A-2) | 10.6 mg |
| | Phenol 72% aqueous solution | 0.02 cc |
| | Compound (A-3) | 0.424 g |
| (iv) | Water | 68.8 cc |
| (v) | Compound (A-4) 4.3% aqueous solution | 3 cc |

The structural formulae of compounds (A-1) to (A-4) and comparative sensitizing dye SD-1 are shown hereinafter in Table A.

The emulsion coating liquids obtained in this way were coated together with the surface protecting layer coating liquid, by a simultaneous extrusion method onto a poly(ethylene terephthalate) film support, in such a way that the volume ratio respectively at the time of coating was 103:45. The coated weight of silver was 2.5 g/m$^2$. These samples were exposed (1/100th second) through a yellow filter and an optical wedge using a sensitometer. After development for 30 seconds at 35° C. in an RD-III developer for automatic processors (made by the Fuji Photo Film Co., Ltd.), the samples were fixed, washed and dried in the usual way and the photographic speeds were measured. The photographic speed is represented by a relative value of the reciprocal of the exposure required to provide an optical density of fog+0.2, the value for Sample No. 1 being taken to be 100.

the present invention with a selenium sensitizer of the present invention.

EXAMPLE 2

(Tabular Silver Iodobromide Grains)

Fine Grained Silver Iodobromide Emulsion II-A

A 1.2 mol silver nitrate solution and an aqueous halogen salt solution which contained 1.11 mol of potassium bromide and 0.09 mol of potassium iodide (1200 ml of each solution) were added over a period of 15 minutes with agitation using the double jet method to 2.6 liters of a 2.0 wt % gelatin solution which contained 0.026 mol of potassium bromide. The gelatin solution was maintained at a temperature of 35° C. during this time. Subsequently, the emulsion was washed using the normal flocculation method. Thirty grams of gelatin were added and, after dissolution, the pH value was adjusted to 6.5 and the pAg value was adjusted to 8.6. The fine silver iodobromide grains obtained (silver iodide content 7.5%) had an average grain size of 0.07 μm.

Tabular Silver Bromide Core Emulsion II-B

A 2.0 mol silver nitrate solution and a similar 2.0 mol potassium bromide solution (30 cc of each) were added with agitation using the double jet method to 2 liters of a 0.8 wt % gelatin solution which contained 0.09 mol of potassium bromide. The gelatin solution in the reactor was maintained at a temperature of 30° C. during this time. After the addition, the temperature was raised to 75° C. and 40 grams of gelatin were added. Next, a 1.0 mol silver nitrate solution was added and the pBr value was set to 2.55. Then, 150 grams of silver nitrate was added at an accelerating flow rate (the final flow rate was ten times the initial flow rate) over a period of 60 minutes, a solution of potassium bromide being added at the same time using the double jet method in such a way that the pBr value was maintained at 2.55.

Subsequently, the emulsion was cooled to 35° C. and washed using the normal flocculation method, 60 grams of gelatin was added. After dissolving at 40° C., the pH value was adjusted to 6.5 and the pAg value was adjusted to 8.6. The tabular silver bromide grains obtained had an average corresponding circle diameter of 1.4 μm and a thickness of 0.2 μm, and they were monodisperse tabular grains of which the variation coefficient of the

TABLE 1-1

| Sample Number | Sensitizer* | Sensitizing Dye II | Sensitizing Dye III | Amount of III Added (mol %/II) | Relative Speed | Relationship with this Application |
|---|---|---|---|---|---|---|
| 1 | Sodium Thiosulfate | SD-1 | None | — | 100 | Comparative Example |
| 2 | Sodium Thiosulfate | SD-1 | III-5 | 2 | 100 | Comparative Example |
| 3 | Sodium Thiosulfate | II-1 | III-5 | 2 | 102 | Comparative Example |
| 4 | I-1 | SD-1 | None | — | 102 | Comparative Example |
| 5 | I-1 | II-1 | None | — | 110 | This Invention |
| 6 | I-1 | II-1 | III-5 | 0.5 | 118 | This Invention |
| 7 | I-1 | II-1 | III-5 | 2 | 125 | This Invention |
| 8 | I-21 | II-12 | III-14 | 2 | 130 | This Invention |
| 9 | I-21 | II-12 | III-17 | 2 | 128 | This Invention |

TABLE 1-2

| Sample Number | Sensitizer* | Sensitizing Dye II | Sensitizing Dye III | Amount of III Added (mol %/II) | Relative Speed | Relationship with this Application |
|---|---|---|---|---|---|---|
| 10 | I-21 | II-12 | III-19 | 2 | 131 | This Invention |
| 11 | I-21 | II-2 | III-20 | 2 | 119 | This Invention |
| 12 | I-21 | II-2 | III-2 | 2 | 122 | This Invention |

*: The amount of sensitizing dye added was $2 \times 10^{-6}$ mol/mol.AgX.

It is clear from Table 1 that a higher photographic speed can be realized by combining a sensitizing dye of corresponding circle diameter was 15%.

Tabular Silver Iodobromide Emulsion II-C

Emulsion II-B which contained silver bromide corresponding to 50 grams as silver nitrate was dissolved in 1.1 liters of water. The temperature was maintained at 75° C. and the pBr value was maintained at 1.5. Next, 1 gram of 3,6-dithiaoctan-1,8-diol was added and then the fine grained emulsion II-A was added immediately to the reactor at a fixed flow rate over a period of 50 minutes in an amount calculated as silver nitrate of 100 grams. The tabular grains obtained had an average corresponding circle diameter of 2.4 μm and a grain thickness of 0.31 μm.

Subsequently, the emulsion was washed using the normal flocculation method. The pH value was adjusted to 6.5 and the pAg value was adjusted to 8.6.

The emulsion obtained was divided into seven portions. After adding the sensitizing dye shown in Table 2 at 56° C., 1-(3-sulfophenyl) -5-mercaptotetrazole sodium salt and the sensitizer shown in Table 2 were added. Then chloroauric acid ($1\times10^{-5}$ mol/molAgX) and potassium thiocyanate ($6\times10^{-1}$ mol/molAgX) were added and the mixtures were chemically ripened optimally. Subsequently, the compounds indicated below were added and the emulsions were coated, together with a protective layer, using a simultaneous extrusion method onto an undercoated triacetylcellulose film support to prepare Sample Nos. 13 to 19.

(1) Emulsion Layer
Emulsion: The emulsion shown in Table 2
Coupler: (The coupler (B-1) indicated hereinafter in Table B)
Tricresyl phosphate
Stabilizer: 4-Hydroxy-6-methyl-1,3,3a,7-tetraazaindene
Coating Promoter: Sodium dodecylbenzenesulfonate
(2) Protective Layer
Fine poly(methyl methacrylate) particles
2,4-Dichloro-6-hydroxy-s-triazine sodium salt
Gelatin These samples were subjected to an exposure for sensitometric purposes (1/100th second), and then they were color developed and processed as indicated below.

The processed samples were subjected to density measurements using a green filter. The results obtained for photographic performance are shown in Table 2. The relative speeds shown are those observed when the speed of Sample No. 13 is taken to be 100.

Processing Method

| Process | Processing Time | Processing Temperature |
|---|---|---|
| Color development | 3 min. 15 sec. | 38° C. |
| Bleach | 3 min. 00 sec. | 38° C. |
| Water Wash | 30 sec. | 24° C. |
| Fix | 3 min. 00 sec. | 38° C. |
| Water Wash (1) | 30 sec. | 24° C. |
| Water Wash (2) | 30 sec. | 24° C. |
| Stabilization | 30 sec. | 38° C. |
| Drying | 4 min. 20 sec. | 55° C. |

The compositions of the liquids are indicated below.

| | (Units: Grams) |
|---|---|
| Color Developer | |
| Diethylenetriamine pentaacetic acid | 1.0 |
| 1-Hydroxyethylidene-1,1-diphosphonic acid | 3.0 |
| Sodium sulfite | 4.0 |
| Potassium carbonate | 30.0 |
| Potassium bromide | 1.4 |
| Potassium iodide | 1.5 mg |
| Hydroxylamine sulfate | 2.4 |
| 4-[N-ethyl-N-β-hydroxyethylamino]-2-methylaniline sulfate | 4.5 |
| Water to make | 1.0 liter |
| pH | 10.05 |
| Bleach | |
| Sodium ethylenediamine tetraacetato ferrate trihydrate | 100.0 |
| Disodium ethylenediamine tetraacetate | 10.0 |
| 3-Mercapto-1,2,4-triazole | 0.08 |
| Ammonium bromide | 140.0 |
| Ammonium nitrate | 30.0 |
| Aqueous ammonia (27%) | 6.5 ml |
| Water to make | 1.0 liter |
| pH | 6.0 |
| Fixer | |
| Disodium ethylenediamine tetraacetate | 0.5 |
| Ammonium sulfite | 20.0 |
| Aqueous ammonium thiosulfate solution (700 g/liter) | 290.0 ml |
| Water to make | 1.0 liter |
| pH | 6.7 |
| Stabilizer | |
| Sodium p-toluenesulfonate | 0.03 |
| Polyoxyethylene p-monononylphenyl ether (average degree of polymerization 10) | 0.2 |

TABLE 2

| Sample Number | Sensitizer* | Sensitizing Dye II | Sensitizing Dye III | Amount of III Added (mol %/II) | Fresh Performance Relative Speed | Stored for 3 Days at 50° C., 80% RH Relative Speed | Relationship with this Application |
|---|---|---|---|---|---|---|---|
| 13 | Sodium Thiosulfate | SD-1 | None | — | 100 | 60 | Comparative Example |
| 14 | Sodium Thiosulfate | II-1 | III-5 | 2 | 102 | 67 | Comparative Example |
| 15 | I-21 | SD-1 | None | — | 103 | 70 | Comparative Example |
| 16 | I-21 | II-1 | III-5 | 1 | 121 | 95 | This Invention |
| 17 | I-21 | II-8 | III-2 | 1 | 125 | 93 | This Invention |
| 18 | I-11 | II-8 | III-14 | 1 | 118 | 92 | This Invention |
| 19 | I-11 | II-14 | III-17 | 2 | 115 | 85 | This Invention |

*:The amount of sensitizer added was $2\times10^{-6}$ mol/mol.AgX

The processing liquid used in each process is indicated below.

| | |
|---|---|
| Disodium ethylenediamine tetraacetate | 0.05 |
| 1,2,4-Triazole | 1.3 |
| 1,4-Bis(1,2,4-triazol-1-ylmethyl)- | 0.75 |

-continued

| | (Units: Grams) |
|---|---|
| piperazine | |
| Water to make | 1.0 liter |
| pH | 8.5 |

As is clear from Table 2, the photographic speed of the green region can be increased with a combination according to the present invention.

EXAMPLE 3

(1) Preparation of the Emulsion

Emulsion A-1

One liter of a 0.7% aqueous solution of inert ossein gelatin which contained 0.57 mol (per liter of solution, same hereinbelow) of potassium bromide (solution A) was stirred while being maintained at 30° C. An aqueous 1.95 mol potassium bromide solution (solution B) and an aqueous 1.9 mol silver nitrate solution (solution C) were added to this solution at a constant flow rate over a period of 30 seconds using the double jet method (consuming 2.06% of the total amount of silver nitrate). Moreover, the temperature was raised to 75° C. after adding 400 ml of a deionized 8% gelatin solution. An aqueous 1.12 mol silver nitrate solution (solution D) was added. After adjusting the pBr value to 2.13 (consuming 1.84% of the total amount of silver nitrate), 14.7N aqueous ammonia solution was added and the pH was adjusted to 8.3. After physical ripening, 1N nitric acid was added and the pH was readjusted to 5.5. An aqueous 1.34 mol potassium bromide solution (solution E) and solution D were added simultaneously over a period of 11 minutes while accelerating the flow rate (the final flow rate was 2.5 times the initial flow rate) in such a way that the pBr value was maintained at 1.56 (consuming 12.8% of the total amount of silver nitrate). Then 1N NaOH was added and the pH was adjusted to 9.3. An aqueous solution which contained 1.34 mol potassium bromide and 0.108 mol potassium iodide (solution F) and solution D were added simultaneously over a period of 28.5 minutes while accelerating the flow rate (the final flow rate was 5.5 time the initial flow rate) in such a way that the pBr value was maintained at 1.56 (consuming 67.3% of the total amount of silver nitrate). An aqueous 0.14 mol potassium iodide solution (100 cc) (solution G) was added over a period of 10 minutes. After 10 minutes had elapsed from the completion of this addition, solution D and an aqueous 1.34 mol potassium bromide solution (solution H) were added simultaneously over a period of 10 minutes with an accelerating flow rate (the final flow rate was twice the initial flow rate) in such a way that the pBr value was maintained at 2.42 (consuming 16% of the total amount of silver nitrate). Next, the emulsion was desalted using the normal flocculation method to provide tabular AgBrI (5 mol% silver iodide) of which the average particle diameter/thickness ratio was 6.5 and the corresponding sphere diameter was 1.2 μm.

The emulsion obtained was divided into six portions. After adding the sensitizing dye shown in Table 3 at 56° C., 1-(3-sulfophenyl)-5-mercaptotetrazole sodium salt, and sensitizer were added and then chloroauric acid ($1.2\times10^{-5}$ mol/molAg) and potassium thiocyanate ($4.0\times10^{-4}$ mol/molAg) were added and the mixtures were ripened optimally. Here, optimally signifies that the highest speed was obtained on exposure for 1/100th of a second.

Sample Preparation

The emulsions 20 to 25 were used to prepare Sample Nos. 20 to 25 by coating onto a TAC (triacetylcellulose) base under the coating conditions indicated below.

Emulsion Coating Conditions

| | |
|---|---|
| * Emulsion: The various emulsions (emulsions 20 to 25) | $2.1\times10^{-2}$ mol/m$^2$ as silver |
| * Coupler: (C-1) | $1.5\times10^{-3}$ mol/m$^2$ |
| * Tricresyl phosphate | 1.10 g/m$^2$ |
| * Gelatin | 2.30 g/m$^2$ |

(2) Protective Layer

| | |
|---|---|
| * 2,4-Dichloro-6-hydroxy-s-triazine sodium salt | 0.08 g/m$^2$ |
| * Gelatin | 1.80 g/m$^2$ |

These samples were left to stand for 14 hours under conditions of 40° C., 70% RH. Then they were exposed for 1/100th second through a continuous wedge and a gelatin filter YF made by the Fuji Photo Film Co., Ltd. and color developed and processed in the way indicated below.

The processed samples were subjected to density measurements using a green filter.

| Process | Processing Time | Processing Temperature |
|---|---|---|
| Color development | 2 min. 00 sec. | 40° C. |
| Bleach-Fix | 3 min. 00 sec. | 40° C. |
| Water Wash (1) | 20 sec. | 35° C. |
| Water Wash (2) | 20 sec. | 35° C. |
| Stabilization | 20 sec. | 35° C. |
| Drying | 50 sec. | 65° C. |

The compositions of the processing liquids are indicated below.

| | (Units: Grams) |
|---|---|
| Color Developer | |
| Diethylenetriamine pentaacetic acid | 2.0 |
| 1-Hydroxyethylidene-1,1-diphosphonic acid | 3.0 |
| Sodium sulfite | 4.0 |
| Potassium carbonate | 30.0 |
| Potassium bromide | 1.4 |
| Potassium iodide | 1.5 mg |
| Hydroxylamine sulfate | 2.4 |
| 4-(N-Ethyl-N-β-hydroxyethylamino)-2-methylaniline sulfate | 4.5 |
| Water to make | 1.0 liter |
| pH | 10.05 |
| Bleach-fixer | |
| Ammonium ethylenediamine tetraacetato ferrate dihydrate | 90.0 |
| Disodium ethylenediamine tetraacetate | 5.0 |
| Sodium sulfite | 12.0 |
| Aqueous ammonium thiosulfate solution (70%) | 260.0 ml |
| Acetic acid (98%) | 5.0 ml |
| Bleaching accelerator (C-2) | 0.01 mol |
| Water to make | 1.0 liter |
| pH | 6.0 |

Water Washing Water

Tap water was treated by being passed through a mixed bed type column which had been packed with an H-type strongly acidic cation exchange resin (Amberlite IR-120B made by the Rohm and Haas Co.) and an OH-type anion exchange resin (Amberlite IR-400 made by the same company) so that the calcium and magnesium ion concentrations were less than 3 mg/liter. Then 20 mg/liter of sodium dichloroisocyanurate and 1.5 g/liter of sodium sulfate were added. The pH of this liquid was in the range 6.5 to 7.5.

| Stabilizer | (Units: Grams) |
|---|---|
| Formalin (37%) | 2.0 ml |
| Polyoxyethylene p-monononylphenyl ether (average degree of polymerization 10) | 0.3 |
| Disodium ethylenediamine tetraacetate | 0.05 |
| Water to make | 1.0 liter |
| pH | 5.0–8.0 |

The structural formulae of the coupler (C-1) and the bleaching accelerator (C-2) are shown hereinafter in Table C.

The photographic speed is indicated by the relative value of the reciprocal of the exposure expressed in luxseconds which gave a density of fog+0.2.

TABLE 3

| Sample Number | Sensitizer* | Sensitizing Dye II | Sensitizing Dye III | Amount of III Added (mol %/II) | Relative Speed | Relationship with this Application |
|---|---|---|---|---|---|---|
| 20 | Sodium Thiosulfate | SD-1 | None | — | 100 | Comparative Example |
| 21 | Sodium Thiosulfate | II-1 | None | — | 100 | Comparative Example |
| 22 | Sodium Thiosulfate | II-1 | III-5 | 2 | 105 | Comparative Example |
| 23 | I-21 | II-1 | III-5 | 2 | 119 | This Invention |
| 24 | I-21 | II-1 | III-2 | 2 | 128 | This Invention |
| 25 | I-21 | II-1 | III-20 | 2 | 123 | This Invention |

TABLE A

Compound (A-1)

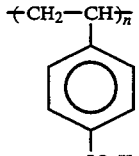

$SO_3K$ n = ca. 3000

Compound (A-2)

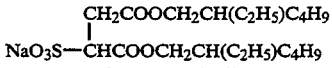

Compound (A-3)

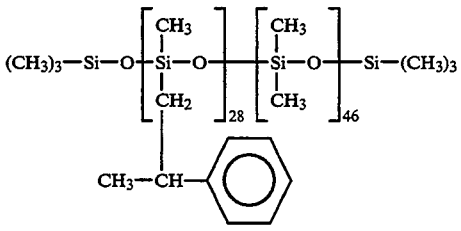

Compound (A-4)

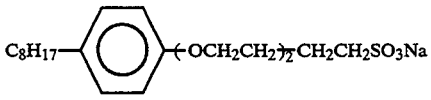

SD-1

TABLE A-continued

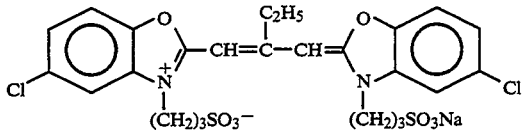

TABLE B

Coupler (B-1)

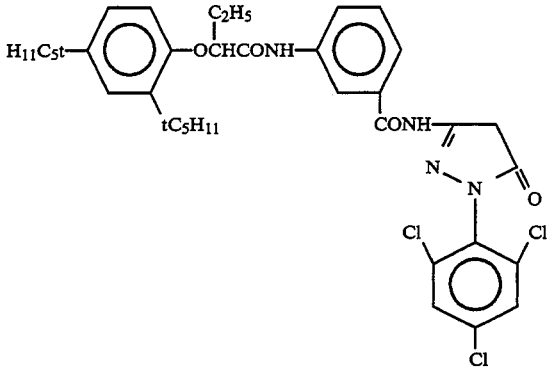

TABLE C

Coupler (C-1)

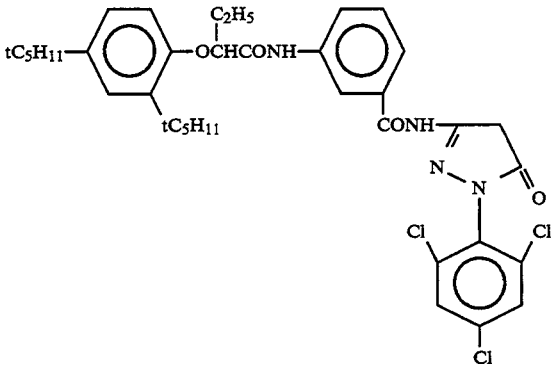

Bleaching Accelerator (C-2)

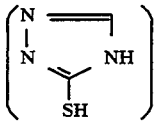

As is clear from Table 3, a photosensitive material which has high speed and which has excellent storage stability can also be obtained by combination of the present invention even in a tabular AgBrI emulsion system.

EFFECT OF THE INVENTION

The effects of increasing the spectral sensitivity of the green short wavelength region and of inhibiting the lowering of photographic speed of the color photographic photosensitive material on storage are obtained.

While the invention has been described in detail and with reference to specific embodiments thereof, it will be apparent to one skilled in the art that various changes and modifications can be made therein without departing from the spirit and scope thereof.

What is claimed is:

1. A silver halide color photographic photosensitive material which has been sensitized with a selenium sensitizer represented by formula (I) below and which comprises a green sensitive photosensitive silver halide emulsion layer which has been spectrally sensitized with a sensitizing dye represented by formula (II) below:

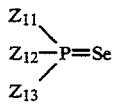

(I)

wherein $Z_{11}$, $Z_{12}$ and $Z_{13}$ may be the same or different and each represents an alkyl group, an aryl group, a heterocyclic group, a halogen atom, a hydrogen atom, $—OR_{11}$, $—NR_{12}(R_{13})$, $—SR_{14}$ or $—SeR_{15}$, $R_{11}$, $R_{14}$ and $R_{15}$ may be the same or different and represent alkyl groups, aryl groups, heterocyclic groups, hydrogen atoms or cations, and $R_{12}$ and $R_{13}$ may be the same or different and represent alkyl groups, aryl groups, heterocyclic groups or hydrogen atoms,

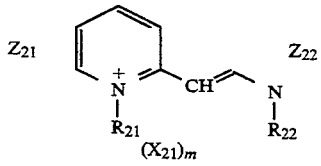

(II)

wherein $R_{21}$ and $R_{22}$ each represents an alkyl group, $Z_{21}$ represents a group of atoms which is required to form a benzene ring, $Z_{22}$ represents a group of atoms which is required to form a benzothiazole or benzoselenazole nucleus, $X_{21}$ represents a counter-ion, m represents 0 or 1, and m is 0 where an intramolecular salt is formed.

2. The silver halide color photographic photosensitive material as in claim 1, wherein the green sensitive photosensitive silver halide emulsion contains a sensitizing dye represented by formula (III) below:

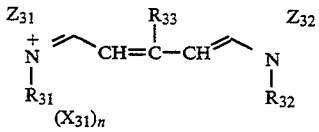

(III)

wherein $R_{31}$, $R_{32}$ and $R_{33}$ each represents an alkyl group, $Z_{31}$ and $Z_{32}$ may be the same or different and each represents a group of atoms which is required to form a benzoxazole nucleus, a naphthoxazole nucleus, a benzothiazole nucleus, a naphthothiazole nucleus, a benzimidazole nucleus or a naphthimidazole nucleus, $X_{31}$ represents a counter ion, n represents 0 or 1, and n is 0 where an intramolecular salt is formed.

3. The silver halide color photographic photosensitive material as in claim 1, wherein the selenium sensitizer represented by formula (I) is a trialkylphosphine selenide, a triarylphosphine selenide, a trialkyl selenophosphate or a triaryl selenophosphate.

4. The silver halide color photographic photosensitive material as in claim 1, wherein both $R_{21}$ and $R_{22}$ in formula (II) have sulfoalkyl substituents.

5. The silver halide color photographic photosensitive material as in claim 1, wherein $R_{21}$ or $R_{22}$ in formula (II) is a sulfoethyl, sulfopropyl, sulfobutyl, carboxymethyl or carboxyethyl group.

6. The silver halide color photographic photosensitive material as in claim 1, wherein both $R_{21}$ and $R_{22}$ in formula (II) are a sulfoethyl, sulfopropyl, sulfobutyl, carboxymethyl or carboxyethyl groups.

7. The silver halide color photographic photosensitive material as in claim 2, wherein the nucleus formed by $Z_{31}$ or $Z_{32}$ in formula (II) is a benzothiazole, benzoxazole or naphthoxazole nucleus.

8. The silver halide color photographic photosensitive material as in claim 2, wherein $R_{31}$ or $R_{32}$ in formula (III) is a sulfoethyl, sulfopropyl, sulfobutyl, carboxymethyl or carboxyethyl group.

9. The silver halide color photographic photosensitive material as in claim 2, wherein both $R_{31}$ and $R_{32}$ in formula (III) are a sulfoethyl, sulfopropyl, sulfobutyl, carboxymethyl or carboxyethyl groups.

* * * * *